United States Patent [19]

Jones

[11] 4,335,515

[45] Jun. 22, 1982

[54] DRAFTING DEVICE FOR PRODUCING CONCENTRIC LINES

[76] Inventor: Raymond L. Jones, 6125 Manning, Raytown, Mo. 64133

[21] Appl. No.: 221,027

[22] Filed: Dec. 29, 1980

Related U.S. Application Data

[60] Division of Ser. No. 59,789, Jul. 23, 1979, Pat. No. 4,275,502, which is a continuation-in-part of Ser. No. 971,934, Dec. 21, 1978, abandoned.

[51] Int. Cl.[3] ..... B43L 11/06

[52] U.S. Cl. ..... 33/27 L

[58] Field of Search ..... 33/27 L, 27 C, 41 R, 33/41 B, 42, 174 B, 174 G; 30/289, 293

[56] References Cited

U.S. PATENT DOCUMENTS

| | | | |
|---|---|---|---|
| 1,383,759 | 7/1921 | Romie | 33/41 B |
| 2,561,585 | 7/1951 | McKillop | 33/41 R |
| 2,782,506 | 2/1957 | Igram | 33/41 R |
| 3,465,445 | 9/1969 | Fisher | 33/41 R X |
| 3,509,631 | 5/1970 | Shimoyama | 33/27 C |
| 4,057,898 | 11/1977 | Piosky | 33/174 B X |
| 4,275,502 | 6/1981 | Jones | 33/27 L |

*Primary Examiner*—Charles E. Phillips

*Attorney, Agent, or Firm*—Thomas M. Scofield

[57] ABSTRACT

An improved drafting device for use in association with drafting templates and forms, both the internal and external shapes, configurations and designs thereof; a circular disc having a rim adapted to underlie the internal or external edge of a template, an optional central underside base to minimize pencil and ink interference from movement of the base, openings or slots to permit pencil, pen or blade insertion through the disc so as to mark or cut spaced sets of lines or cuts in the work sheet under the template, an upper central wall on the disc to ride against the template form and an optional outboard flange on the central wall to override and engage the work; improved devices for drawing concentric lines with respect to template inner and outer forms, including both large and small templates.

9 Claims, 18 Drawing Figures

Fig. 13.
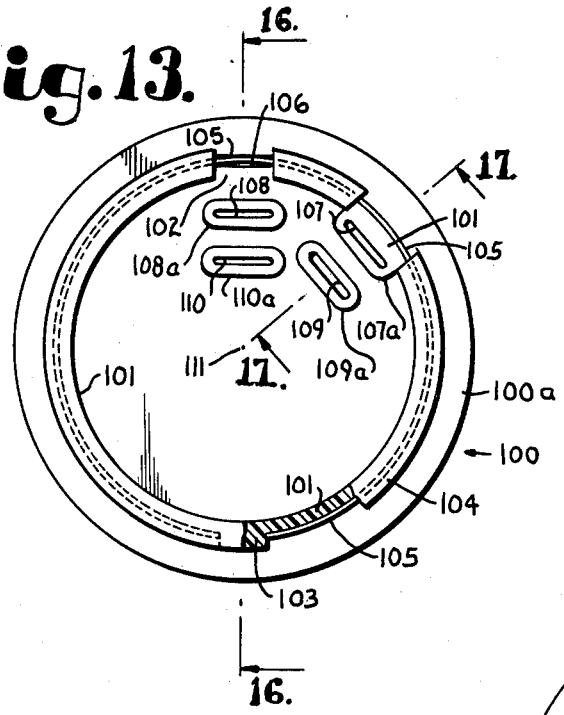
Fig. 18.
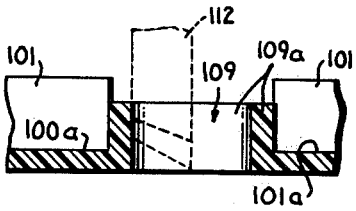
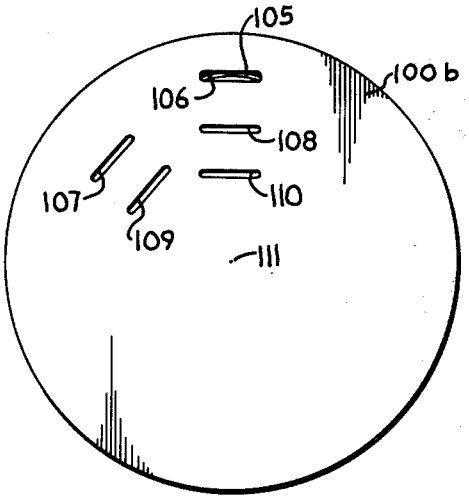
Fig. 14.
Fig. 15.
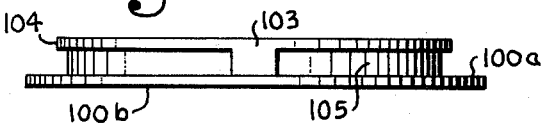
Fig. 17.
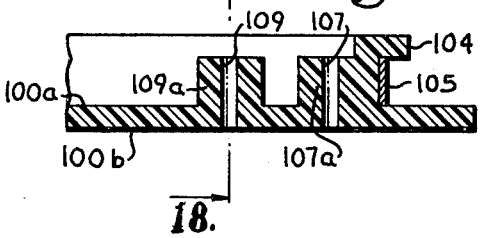
Fig. 16.
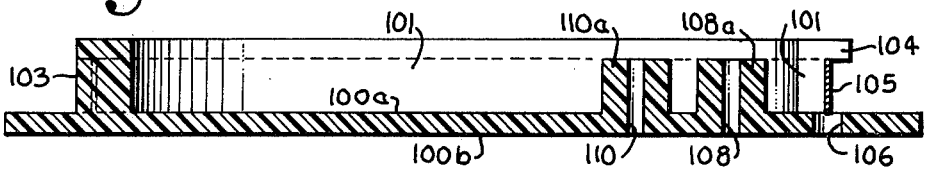

DRAFTING DEVICE FOR PRODUCING CONCENTRIC LINES

This application is a division of my U.S. application Ser. No. 059,789, filed July 23, 1979 for "Drafting Device For Producing Concentric Lines", now U.S. Pat. No. 4,275,502 issued June 30, 1981, which case was a continuation-in-part of my U.S. Ser. No. 971,934, filed Dec. 21, 1978, same title, now abandoned.

BACKGROUND OF THE INVENTION

A template typically comprises a plastic sheet with circular and/or elliptical openings of various sizes and shapes formed therein to permit a draftsman to reproduce the ellipses, circles or other shapes by placing the template over the work with respect to which he is engaged and tracing the shape of the opening on the work. Frequently, it is desired or necessary to be able to produce concentric circles, ellipses or other traced shapes with respect to a given template shape, conforming to the template design yet of different dimension. These remarks apply to template form defined cuttings as well as markings or tracings.

The prior art has produced a multiplicity of such devices, as will be evidenced by some of the citations given herebelow. However, the prior art devices suffer from a number of shortcomings. For example, many of the devices are excessively expensive to produce in operative form, either because of cost or because of the complexity or delicacy of the parts of the device. Other devices are not adaptable to varying circumstances, shapes or template forms; that is, they are not sufficiently versatile in use. Other devices fail to retain accuracy as they trace within or around the template configuration. Still other devices are limited to work in a specific or special environment and are not generally adapted to engineering template work.

What is desired is an extremely simple device which may be employed with template forms, both external and internal, of the most varied shape. Still another external and internal, involve the device being produceable in a multiplicity of sizes (to form a complete set for a given drafting purpose), all of the members of the set having a congruent pattern of form, differing only in size and placement of the operative parts thereof to achieve the various goals. Yet further, the device must be rugged, simple, have all the portions thereof readily available for cleaning and be relatively cheap to manufacture in mass production, while retaining exact construction and configuration for use in precise drafting work.

THE PRIOR ART

I am aware of the following patterns directed and relating to similar problems with respect to tracing around or within patterns and templates;

Allred U.S. Pat. No. 1,863,091 "Drawing Instrument", issued June 14, 1932;

Hoferer U.S. Pat. No. 1,878,633 "Device For Making Designs", issued Sept. 20, 1932;

Suffich U.S. Pat. No. 2,212,703 "Drawing Instrument", issued Aug. 27, 1940;

Nath U.S. Pat. No. 2,509,164 "Drafting Device", issued May 23, 1950;

McKillip U.S. Pat. No. 2,561,585 "Drawing Instrument", issued July 27, 1951;

Ingram U.S. Pat. No. 2,782,506 "Rotary Device For Rapid Grading Of Patterns", issued Feb. 26, 1957;

Fisher U.S. Pat. No. 3,230,624 "Design Instruments Or Apparatus", issued Jan. 25, 1966; and Fisher U.S. Pat. No. 3,465,445 "Drawing And Design Apparatus Or Instrument", issued Sept. 9, 1969.

OBJECTS OF THE INVENTION

A first object of the subject invention is to provide a new and novel device for producing concentric parallel lines inside of, as well as outside of, template guides of various configurations. Particularly, the subject device is advantageous in producing concentric parallel lines within circular or elliptical template guides.

Another object of the invention is to provide improved drafting instruments which greatly increase the versatility of use of conventional templates and line guides used in drafting or drawing.

Another object of the invention is to provide such improved drafting devices, which devices may be produced in precisely sized sets, whereas to give a draftsman owing and using such sets the greatest possible versatility with respect to use of his templates and line guides. Thus, one device, in use, most accurately permits the drawing or production of a multiplicity of precisely spaced lines concentric to (within or without) templates and line guides of the most varied configuration and description. The other device enables the draftsman to make precise cutouts of shapes defined by the template.

Another object of the invention is to produce and provide such improved drafting devices of the most precise and accurate character, such mass produceable, yet of strong and rugged construction over a long life of use, wherein all parts thereof are constantly and readily available for cleaning.

Yet another object of the invention is to provide such an improved drafting device wherein, once the device is inserted within the template, the device permits the drawing of the line defined by the template shape, per se and, thereafter, without removing or substantially moving the improved guide, one or more concentric spaced lines with respect thereto, as desired.

Another object of the invention is to provide such improved drafting devices for use both inside and outside of template constructions and line guides, wherein the configuration of the device itself securely and firmly grasps the template in question, whereby to maintain accuracy in the carrying out of the function of the device (and, additionally, minimize contact and interference with pencilled and/or inked lines already drawn in use of the drawing modification of the device).

Still another object of the invention is to provide such devices, as described, of the greatest simplicity and economy of structure, yet which are admirably designed for their operative purposes and perfect in the carrying out of their functions.

Yet another object of the invention is to provide an optimum form of device wherein a swivel knife is employed with the device so as to cut the work sheet, piece or object in a manner precisely guided by the template form either at the precise template outline or spaced therefrom at one of several defined intervals. This cutting device is so constructed as to at all times protect the template from the knife being used.

DRAWINGS

In the drawings, which form a part of the instant specification and are to be read in conjunction therewith, embodiments of the invention are shown and, in the various views, like numerals are employed to indicate like parts.

FIGS. 7–10, inclusive are detail plan views, from above, of the overall outlines of the alternate discs of the set of discs usable with the disc of FIGS. 1–6, inclusive. All of the discs of these figures are shown sized in proper relative scale to the disc of FIGS. 1–6, inclusive, but the upper face outer wall and flange, as well as the opposed breaks therein and the slots in the breaks (as particularly seen in FIGS. 4 and 5), are not shown for simplicities' sake.

Figure 7:
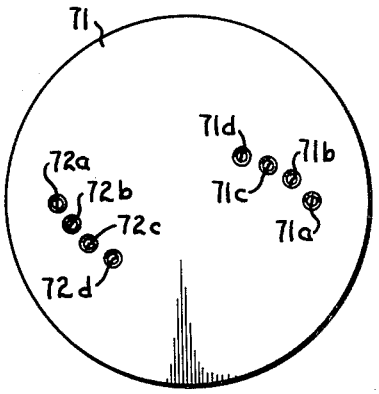
Figure 5:
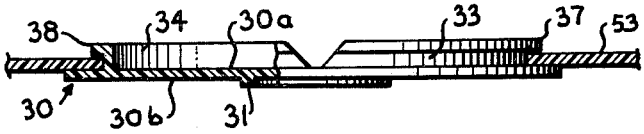
FIG. 5 is an enlarged, side and partly sectional view of the device of FIGS. 1–4, inclusive, the device shown in engagement with the template in the left hand side of the view.

FIG. 7 is a plan view from above of the disc of 1.250 inches diameter (assuming the disc of the previous figures is 1.750 inches diameter).

Figure 8:
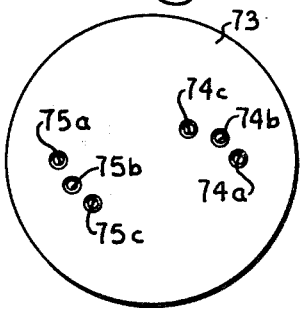
Figure 6:
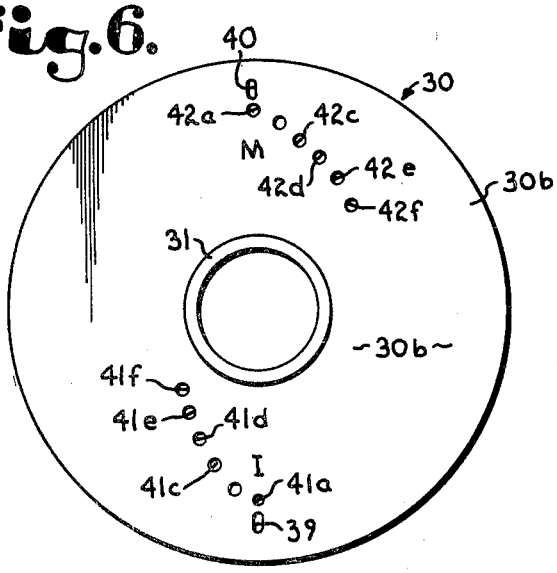
FIG. 6 is an enlarged, bottom view of the device of FIGS. 1–5, inclusive.

FIG. 8 is a like view of a 1.000 inch diameter disc (with only three openings in the set besides the slots).

Figure 9:
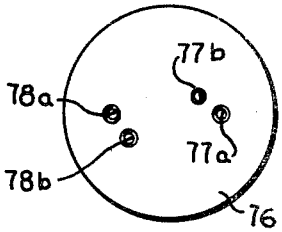

FIG. 9 is a like view of a 0.750 inch diameter disc.

Figure 10:
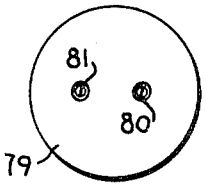

FIG. 10 is a like view of a 0.580 inch diameter disc with only single openings therein (in addition to the slots).

Figure 11:
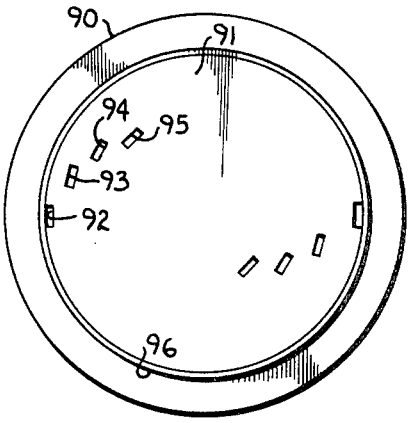

FIG. 11 is a plan view from above of a first modified form of disc adapted for use with a knife, rather than pencil or pen.

Figure 12:
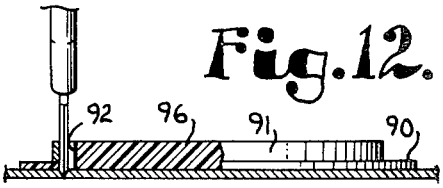
Figure 4:
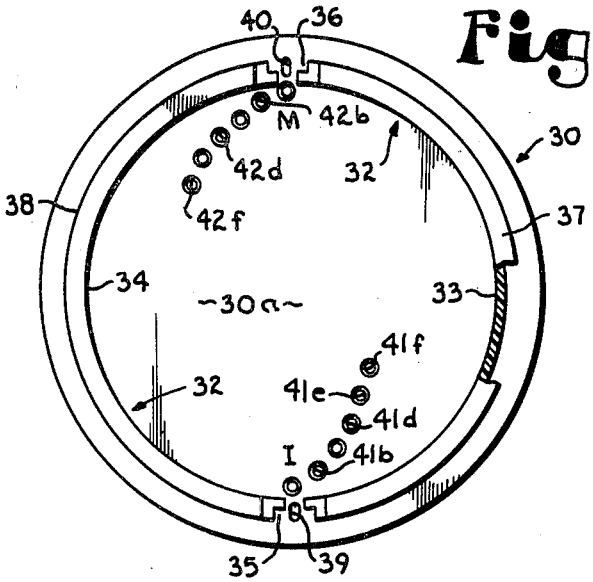
FIG. 4 is an enlarged, plan view of the device of FIGS. 1–3, inclusive with a part cut away to show the upper surface wall and flange structure.

FIG. 12 is a side, partly sectional view of the device of FIG. 11 showing a cutting knife associated therewith.

FIG. 13 is an enlarged, plan view of a second, modified form of disc adapted for use with a knife, rather than pencil or pen, there being a portion cut away to show the upper surface wall and flange construction.

FIG. 14 is an enlarged, bottom view of the device of FIG. 13.

FIG. 16 is a view taken along the line 16—16 of FIG. 13 in the direction of the arrows.

FIG. 18 is a view taken along the line 18—18 of FIG. 17 in the direction of the arrows.

STRUCTURE AND FUNCTION FIGS. 1–6, INCLUSIVE

Referring to the drawings, the subject invention relates to a drafting device for use with a template for drawing concentric lines with respect to the template pattern. The device has, as the largest portion thereof, a flat circular disc generally designated (in FIGS. 1–7, inclusive), 30 with upper side 30*a* and lower side 30*b*. There is a base 31 which is fixed to the lower side of disc 30 preferably precisely centrally thereof (and necessarily at least substantially centrally thereof) which is operative to elevate the disc above a flat supporting surface when the disc is resting thereon. In the construction seen in FIGS. 1–7, inclusive, the base comprises a shallow circular ring or wall.

On the upper side 30*a* of disc 30 there is provided a circular wall or cylindrical ring 32 which may be continuous in one form of the invention, but is here shown as having two separate, interrupted portions 33 and 34. This circular wall 32 or the substantially 180° subdivisions 33 and 34 thereof is (are) of lesser outer diameter than the disc 30 outer diameter and is (are) positioned circumferentially inboard of the peripheral edge of disc 30 and optimally concentric thereto. The zones spacing apart the ends of wall portions 33 and 34 (when wall 32 is not integral or continuous) are numbered 35 and 36.

Optimally, but not necessarily, there is a peripheral or radially outwardly overlying flange fixed to the outboard top portion of the circular wall 32 (33, 34). In FIGS. 1–7, inclusive, this flange is separately numbered on wall portions 33 and 34 as 37 (on wall portion 33) and 38 (on wall portion 34). Should wall 32 be continuous (without interruption zones 35 and 36), the flange portions 37 and 38 would be continuous and integral with one another. The purpose of flange portions 37 and 38 is to overlie the top portion or upper surface of a template while the outboard portion of disc 30, on upper side 30*a* thereof peripheral of wall 32, underlies the lower surface of the template.

In the event that only one series of pencil lead receiving openings were to be provided in disc 30 inboard of wall 32, as will be described, it is contemplated that wall 32 (and flange portions 37 and 39) would be interrupted on only one side of the disc or at one point therealong. Additionally, when two sets of pencil lead openings are provided as seen in FIGS. 1–7, inclusive, it is preferred that the sets of openings be diametrically opposed to one another and the interruptions of wall 32 and flange portions 37 and 38 be diametrically opposed, as seen. However, this is not absolutely necessary, only preferred and optimal. All references to pencil lead openings refer equally to the use of a standard inking pen with the subject device.

Three or four sets of openings may be provided 120° or 90° spaced from one another, respectively. In the latter case, openings may be provided spaced one-eighth inches and 2 millimeters from one another for convenience.

Referring now to the openings adapted to receive a pencil lead therethrough, there are three classes of openings;

(1) The first class is at least one slot in one of the intervals 35 or 36 which is adapted to receive a lead which will draw the line at the edge of the template opening or at the template periphery which would be drawn even if the device in question were not present. The purpose of these slots is to permit the drawing of such a line when the device is positioned with respect to the template to additionally draw the concentric lines. In this manner, it is not necessary to draw such a line and then lift the template to insert the device, thus perhaps displacing the template. These slots are numbered 39 (bottom edge of FIG. 4) and 40 (top or upper edge of FIG. 4).

(2) A set of openings which draws concentric lines to the base line just noted one sixteenth of an inch apart. This set of openings, six in number in the device of FIGS. 1–7, inclusive, is seen at the right in FIG. 4 and are numbered 41*a*–41*f*, respectively. The concentric lines are one sixteenth inch, one eighth inch, three sixteenths inch, one quarter inch, five sixteenths inch and three eighths inch from the template edge base line, when drawn.

(3) The third set of openings comprises a metric set, with the respective openings one millimeter apart and the base opening one millimeter away from the inboard edge of slot 40. These metric openings are numbered 42*a*–42*f*, inclusive.

Figure 1:
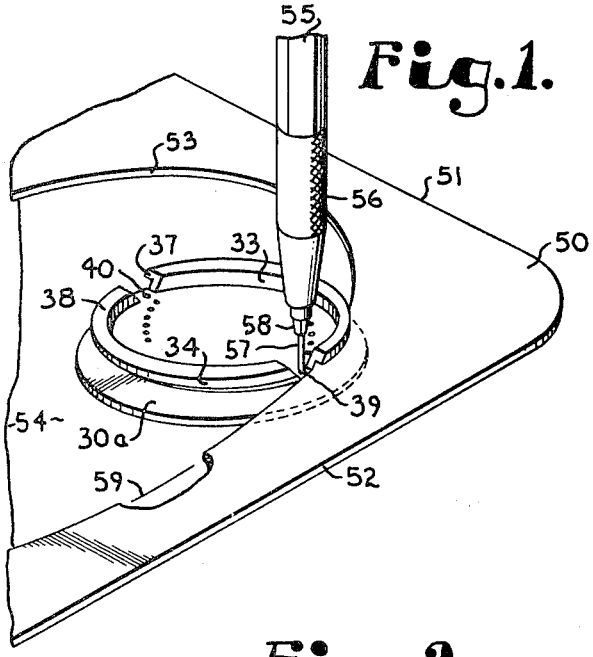
FIG. 1 is a three quarter perspective view from above of the subject guide being used in association with a template, the latter being shown in fragmentary form. The pencil lead of the draftsman is shown in the outer slot, whereby to trace the line for which the template is basically designed.
Figure 2:
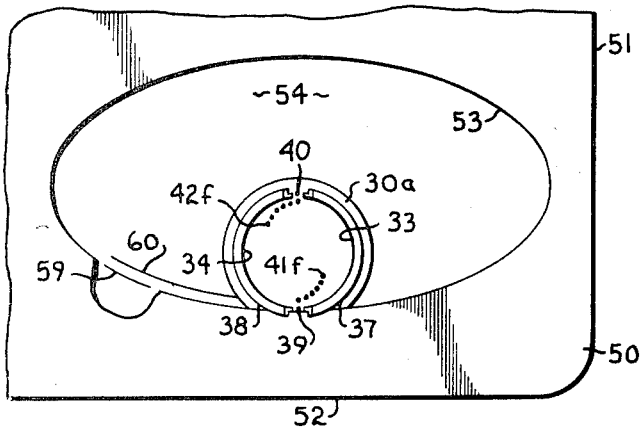
FIG. 2 is a plan view, from above, of the subject device in use in conjunction with a template, showing the drawing of a first inner line after the drawing of the base line, a portion of the template cut away to show the already accomplished drawing of the base line.
Figure 3:
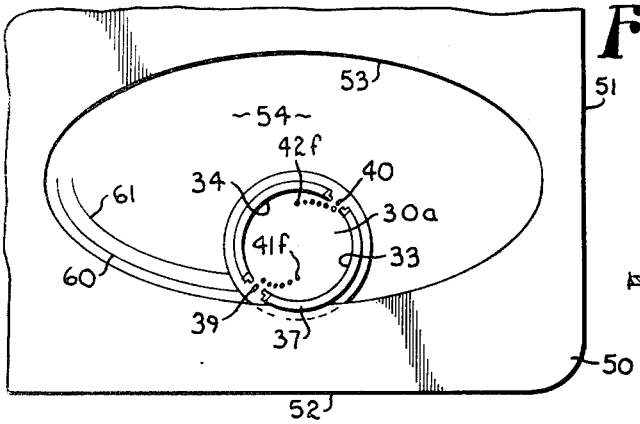
FIG. 3 is a plan view, from above, like that of FIG. 2, showing the drawing of a second, inner concentric line with respect to the template opening. Some of the adjacent openings in the subject device have not been used, thus showing a skipped, spaced concentric line.

The function of the device is best seen in FIGS. 1–3, inclusive and is best described before giving specific dimensions for the example seen in FIGS. 1–6, inclusive, as well as describing the other discs. Turning, then, to FIGS. 1–3, at 50 there is seen the lower right hand edge of a conventional template having one side edge 51 and a lower edge 52. An elliptical opening 53 is shown in the template 50. The device previously described is shown engaged with the template edge defining the ellipse 53. Specifically, disc 30 underlies the body of the template 50 over working surface 54 which is a drawing board, sheet or drawing paper on, typically, a draftsman's table. A pencil 55 having gripping portion 56 adjacent its lower end has conventional drawing lead 57 removably and adjustably gripped in the lead engaging jaws or members 58 of a conventional drafting pencil. In FIG. 1, base line 59 is being drawn against the edge of the template.

In FIG. 2, it may be seen that the base line 59 (left hand portion of the view with template cut away) has been drawn and the first inner concentric line 60, typically drawn from opening 51*a*, one sixteenth inch inboard from line 59, is in the process of being inscribed on the work sheet 54 within opening 53 of template 50. Referring to FIG. 3, in addition to the inner concentric line 60, a line 61 several sixteenth of an inch inboard on the disc of the device has also been drawn. Thus it may be seen that, once the device is emplaced between the template and the work, the base line next to template and one or all of the successive concentric inboard lines may be drawn with respect to the template pattern form before the device is removed from engagement with the template. Either the inch or the metric openings may be used to provide concentric lines (for the inch set) as much as three eighths inches inboard of the base line and as little as one sixteenth or, with respect to the metric set, as close as one millimeter to the base line or as much as six millimeters inboard thereof. Clearly, it is not necessary to draw the base line itself to operate the device, it being possible to select any one or several of the openings. Thus, there are seven choices, including the base line, for both the inch and metric set of openings with the disc of FIGS. 1–6, inclusive. The spacing of the lines drawn in FIGS. 2 and 3 is enlarged for clarity.

It should be understood that, with respect to the other size discs of FIGS. 7–10, inclusive (the discs of successive degrees of smallness moving from FIG. 7 to FIG. 10) the choices are the same, specifically:

(1) There is a metric set and an inch set; and (2) The metric openings are one millimeter apart and the inch openings are one sixteenth of an inch apart. As previously noted in the description of the drawings, the constructions shown in FIGS. 7–10, inclusive illustrate only the patterns of openings inboard of the slots and walls as these patterns constitute the only difference with the disc of FIGS. 1–6 inch save scale differences. The purpose of providing smaller discs (devices) is to permit working within smaller template openings and with small and finely configured outer template structures.

The basic purpose of the overriding flange or collar 37, 38 on the wall 32 (33, 34) is to catch and engage the edge of the template and prevent full tilt of the device off the center boss of base into the penciling or inking that is being done through the openings in the center of disc 30. The purpose of positioning a boss or base 31 under disc 30 is to prevent the disc 30 from smearing the pencil line or inking line (or lines) made or being made. Yet further, the positioning of the base or boss 31 centrally of disc 30 and preferably inboard of all of the openings 41 or 42 is again to avoid smearing of ink or pencil lines being made or made.

TYPICAL DIMENSIONS

Turning to dimensions, the outer diameters of discs 30 for each of the five forms shown in the drawings are preferably 1.750 inches, 1.250 inches, 1.000 inches, 0.750 inches and 0.580 inches. With respect to the five discs, the outer diameter of the circular boss or base 31 in each case is preferably 0.500 inches, 0.375 inches, 0.250 inches, 0.125 inches and 0.125 inches.

For each disc illustrated, preferably the edge slots are 0.034 inches by 0.070 overall. For each disc, typically, the distance from the outer extremity of slots 30 and 40 to the outer edge is 0.075 inches. The thickness of the wall of the ring shaped boss 31, in each case, is typically 0.04 inches.

The height of the boss 31 in all cases is typically 0.020 inches. The thickness of disc 30 in each case, typically, is 0.030 inches. The width of the slot between the upper face 30*a* of disc 30 and the upper edge of flanges 37, 38 is typically 0.046 inches. From the face 30*a* of disc 30 to the top of flanges 37, 38 is typically 0.086 inches.

The peripheral width of flanges 37 and 38 outboard of walls 33 and 34 is typically 0.04 inches. The space from the outboard edge of flanges 37, 38 to the peripheral edge of disc 30 is typically 0.085 inches. From the peripheral face of walls 33, 34 to the edge of disc 30 is typically 0.125 inches. From these last dimensions and the outer diameters of the discs 30, the inner diameters of the illustrated portions of the discs can be calculated, given a wall thickness of walls 33 and 34 (32) of 0.040 inches.

The width of the zones 35 and 36 at the base (face 30*a*) is typically 0.062 inches. Preferably the openings or breaks in the flanges 37 and 38 and walls 33 and 34 are upwardly tapered to a summit width of 0.187 inches. The openings for the pencil lead or inking instruments (openings 41 and 42) are preferably 0.034 inches in diameter.

In the basic disc of FIGS. 1–6, inclusive, the radial distances from center for the openings are, for the inch openings, 0.371 inches, 0.433 inches, 0.495 inches, 0.557 inches and 0.619 inches (41*f* through 41*b*). There is preferably a constant dimension of 0.094 inches between the centers of the holes on each disc, metric or inch. For the inch openings, the outboard inch openings center to the periphery of disc 30 in each case is preferably 0.194 inches. Opening 41*a* is 0.681 inches from center.

Turning to the metric distances from the center in FIGS. 1–6, inclusive, the radial distances are 0.509 inches, 0.548 inches, 0.587 inches, 0.626 inches, 0.665 inches (42*f* through 42*b*). The distance form the periphery of disc 30 to the center of opening 42*a* (and the outboard metric opening in each case in each disc) is preferably 0.171 inches. Opening 42*a* is 0.704 inches from center.

FIGS. 7–10, INCLUSIVE

Turning to the second disc in FIG. 7, the upper face portion thereof being seen at 70, there are provided four inch openings at 71*a–d*. The radial distance from center of openings 71*a–*71*d*, inclusive are 0.245 inches, 0.307 inches and 0.369 inches. Again, there is a 0.094 constant dimension between holes on each disc. The distance from openings 71*a* to the periphery of the disc, as previously mentioned, is 0.194 inches.

The metric openings in the disc of FIG. 7 are designated 72*a–*72*d*, inclusive. The radial distances from center thereof, in reverse order from 72*d*, are 0.337 inches, 0.376 inches and 0.415 inches, with the distance of the center of opening 72*a* from the periphery of the main disc 0.171 inches. The outer diameter of this disc is 1.250 inches.

In FIG. 8 there is seen the next smaller size disc having an outer diameter of one inch. The upper face thereof is designated 73 and has three inch openings 74*a–*74*c* is 0.182 inches. The radial distance from the center of opening 74*b* is 0.244 inches. As previously mentioned, the radial difference between or distance apart of centers of inch openings from one another is one sixteenth inch. This is the case in all discs illustrated. The radial distance apart of the metric openings, one to the next, is one millimeter. In the disc seen in FIG. 8, the radial distance from center of opening 75*c* is 0.251 inches, with a radial distance from center of opening 75*b* 0.290 inches. The outer diameter of the boss 31 in the case of this disc is 0.250 inches. The distance from the center of outer metric opening 75*a* to the edge is 0.171 inch. The analogous distance for opening 74*a* to edge is 0.194 inch.

In FIG. 9, there is seen the upper face 76 of a disc with an outer diameter of 0.750 inches. The boss of the underside of this disc has an outer diameter of 0.125 inches. Two inch openings 77*a* and 77*b* are shown with the radial distance from center of 77*b* of 0.119 inches. Two metric openings are shown, 78*a* and 78*b*, with a radial distance from center of 78*b* of 0.165 inches.

In FIG. 10, there is seen the upper face 79 of a disc having an outer diameter of 0.580 inches. Only one inch opening 80 is seen and one metric opening 81. The distance from the edge of these openings is 0.194 inches and 0.171 inches.

In the case of all of the discs only schematically shown, it should be understood that immediately outboard of the outboardmost inch and metric opening, in each case, but not seen, is a slot as seen in FIGS. 1–6, inclusive. The slot provides the base line drawing against the template. The first inch opening is one sixteenth inch inboard of that. The walls and flanges are not shown (33, 34 for the wall and 37, 38 for the flanges). However, it is assumed that they are positioned on the discs shown in the proportional position to the periphery of the disc indicated as is shown in detail with respect to FIGS. 1–6, inclusive.

On all discs, an "I" and a "M" may be molded near the openings to designate inch and metric openings.

FIGS. 11 AND 12

Herein is shown a single example of a device for use with templates but wherein a cutting knife blade or edge is employed. The basic circular disc 90 has no base on the underside. Mounted integrally thereon is a second circular disc of greater thickness generally designated 91. A first optionally edge dovetailed opening 92 is provided through discs 91 and 90 at the edge of the former. Successive openings 93–95, inclusive are additionally provided spaced radially inwardly. A protective retainer ring 96 of metal may be provided around and attached to the periphery of disc 91. If the band was not present then the outermost opening would preferably be dovetailed inwardly. Slots are shown for both inch and metric spacings on opposite sides of the discs. With the band present no dovetailing is employed.

FIGS. 11 and 12 show a drafting device for use with a template for cutting concentric shapes with respect to the template patterns. It comprises a first, flat circular disc 90 having upper and lower sides thereon. A second flat circular disc 91 is fixed to one face of the first disc 90 centrally thereof and is of less diameter than disc 90. At least one slot 92 is provided extending through both discs inboard of the periphery of the second disc 91 for receiving a cutting means (seen in FIG. 12) therethrough.

A plurality of sequentially inwardly spaced additional slots 93, 94 and 95 are also preferably provided through said discs 90 and 91 inboard of the periphery of second disc 91. The inwardly spaced slots 93–95, inclusive are each successively spaced inwardly a greater distance from the periphery of disc 91, whereby to permit the production of a series of equidistant concentric cuts either within a template opening or outside the template boundary.

The device specifically illustrated in FIGS. 11 and 12 actually includes a pair of slots formed through discs 90 and 91 positioned just inboard of the periphery of the second disc 91, each slot adapted to receive a cutting means therein. The second slot is seen in FIG. 11 opposite slot 92, un-numbered. Slot 92 and this slot are diametrically opposed to one another. A plurality of additional slots is sequentially inwardly spaced through said two discs with respect to the slot opposite 92. Thus it may be seen that each set of said opposed slots makes possible the production of a series of concentric, equally spaced cuts with respect to a template pattern, interior or at the exterior thereof. One of said slots is preferably spaced inwardly by inch measurements, the other by metric measurements.

Preferably, with respect to the device of FIGS. 11 and 12, a metal ring 96 is provided surrounding the periphery of the second disc 91. In this case, it will be seen that the outboardmost pair of slots (slot 92 and that peripheral slot diametrically opposed thereto) formed through said discs just inboard of the periphery of the second disc 91 are positioned immediately inboard of said ring 96, with ring 96 forming the outboardmost wall thereof. FIG. 12 shows the blade of a cutting device inserted in slot 92 with wall 96 outboard thereof.

FIGS. 13–18, INCLUSIVE

The device of FIGS. 13–18, inclusive is an improved form of the cutter disc seen in FIGS. 11 and 12. The differences between these particular devices and forms comprise:

(1) In place of the second disc 91 on base disc 90 on FIGS. 11 and 12, the slots in the inner portion of the device or disc have raised walls therearound, with the exception of the outermost slot;

(2) A circular wall is provided on the disc analogous to wall 34 of FIGS. 1–6, inclusive;

(3) The metal ring 96 of FIGS. 11 and 12 is broken for ease in application; and (4) The retainer flange 38 of FIGS. 1–6, inclusive functions as such in the device of FIGS. 13–18, inclusive and additionally as a ring retainer.

Referring, then, to the cutter disc of FIGS. 13–18, inclusive, at 100 is seen a flat, circular disc having an upper side 100*a* and a lower or lower side 100*b* (FIG. 14). On the upper side 100*a* of disc 100, there is provided a circular wall or cylindrical ring 101 which has an interrupted portion thereof 102. Diametrically opposite this interrupted portion 102, on the periphery of said ring, there is provided a flange, shelf or extension 103. Circular wall 101 is of lesser outer diameter than the disc 100 outer diameter and is positioned circumferentially inboard of the peripheral edge of disc 100 and, optimally, concentric thereto.

Optimally, but not necessarily, there is provided a peripherally or radially outwardly overlying flange 104 fixed to the outboard top portion of circular wall 101. The width of flange 104 is preferably equal to the thickness of extension 103. The purpose of flange 104 in the cutting device is to overlie and help retain broken, metal (optimally steel) ring 105 which lies against the outboard periphery of wall 101 in its extent and has its free ends abutting against extension 103.

A first elongate slot 106 is formed or cut through disc 100 in the zone 102. The length of the slot is oriented substantially on a tangent of the wall 101 extended, that is, essentially in line with the wall. However, the inboard portion of the slot is slightly inboard of the periphery of wall 101 extended and the outboard portion of slot 106 is outboard of the wall 101 extended. Band or ring 105 overlies the outboardmost part of slot 106 and operates, in the case of this slot, to provide a surface between a knife inserted in the slot and the template itself. This serves to protect the template from the knife edge. The device will operate without the band, but unless used extremely carefully, may shave pieces of the template off.

A plurality of inwardly spaced slots 107, 108, 109 and 110 are additionally provided, circumferentially arranged around the center 111 of disc 100. In order to provide guidance and protection with respect to a knife blade inserted through one of these slots, each of these slots are provided with surrounding, upstanding walls 107*a*–110*a*, inclusive. Said walls are preferably of a height substantially that of wall 101, but less than same by approximately the thickness of flange 104. The length of each of the slots 106–110, inclusive is preferably about half the length of a standard swivel knife blade as is seen in FIG. 18 at 112 received within slot 109. The outboard portion of wall 107*a* is preferably integral with wall 101, as may be seen in FIG. 13. Thus there are two interruptions in flange 104, at zone 102 and wall 107*a*. The slot walls also serve, at the ends, for surfaces for the knife blade walls to push against.

Because of the existence and necessary thickness of the slot encircling walls 107*a*–110*a*, inclusive, the sequential series of inwardly spaced slots 106–110, inclusive are staggered into two sets with slots 107 and 109, normally between the slots sequentially numbered, laterally positioned of slots 106, 108 and 110. The purpose of the double width of the slot with respect to the normal width of a knife blade is to position the cutting point-edge of such knife centrally of the slot as may be seen in FIG. 18. This will be the case whether the cut is made in one direction or the other and thus will be independent of handedness of the operator.

In operation of the device of FIGS. 13–18, inclusive, the upper surface of disc 100 peripheral of wall 101 is inserted under a template, as is the case in the device of FIG. 1, with the metal band 105 abutting against the template cutout edge. Alternatively, if tracing the outside of a template, the band would abut the template outer or peripheral edge. If the cut is to be made on the work at the template boundary or edge, the knife is inserted in outboard slot 106 inboard of band 105. The operator then traces the template design by moving the knife along the edge thereof. The purpose of the walls 109 et seq is multi-fold. First, they serve as an edge to push against. Second, they aid in the molding process and, thirdly, they help identify the position of the slots to the user.

While specific dimensions will be set forth with respect to an optimum embodiment, for the present purposes, it is noted that the device illustrated optimally has an outer diameter of 1.250 inches. The outer diameter of wall 101 is approximately 1.000 inches.

When inserting the disc into a template opening, the user should first make sure that the circumference of the device is not greater than the corner of the ellipse, oval or other shape in the template. Working with a one inch diameter device, such cannot be used in 15° or small 20° openings. The work is first secured with tape. When placing the plastic template in desired position, put a couple pieces of tape on one end to make a hinge. The taped hinge will prevent the template from shifting and maintain it in perfect registration. Once a template is removed it is very difficult to try and re-register the work.

A swivel knife necessarily is required for the subject cutting disc. The cutting blade of the knife is inserted in one of the slots and firm downward and slightly outward pressure is applied while pulling the knife around the opening. The knife is to be kept at a 90° angle to the surface. Sharp knife blades always should be used.

There is a "feel" in cutting certain materials. Thin overlay materials require very little pressure. When cutting entirely through paper or card stock one may require three or four rotations of even pressure. The operator should always cut on a firm, hard surface. A soft spongy surface will result in torn edges and poor quality.

While it is possible to provide slots with this form of disc analogous to those seen in FIGS. 11 and 12 (two sets on diametrically opposed sides of the disc), with the double width slots and walls as shown, with displacement laterally of certain openings in the set, it is best to employ different discs for inch spacing and metric spacing. The device may be made in smaller sizes and with lesser slots for tight arcs or small opening templates (ellipses). The knife cutting point at the center of the opening or slot is best for tracking purposes and precision of cut. The device illustrated has (in scale) one sixteenth inch increments between slots.

The corresponding device to that of FIGS. 13–18, inclusive made with metric spacing would have the same number (or one more) of slots and the slot centers would be spaced radially two millimeters apart. Larger discs would typically have more slots and vice versa. A single slot disc would have only the equivalent of slot 105. A two slot disc would have the equivalent of slots 105 and 107.

Referring to dimensions, the outer diameter of disc 100, in a specific embodiment, is 1.250 inches. The distance from the periphery of disc 100 to the outer face of 101 is 0.125 inch. The width of extension 103 may be 0.125 inch. The height of wall 101 above face 100*a* and under flange 104 is 0.065 inch. The thickness of wall 101 is 0.060 inch.

The outer rim slot has a length of 0.156 inch and width of 0.04 inch. The inner slots have the same length and a width of 0.016 inch. The metal band is preferably 0.004 inch spring steel.

The disc 100 is 0.030 inch thick throughout. Flange 104 is of the same thickness. From the top of flange 104 to the underside 100*b* of disc 100 is 0.125 inch.

Working outwardly from slot 110 in reverse order, from center of the disc to center of slot are as follows: to slot 110 is 0.250 inch; to slot 109 is 0.312 inch; to slot 108 is 0.375 inch; to slot 107 is 0.437 inch and to slot 106 is 0.500 inch. Lines from the center 111 of the disc to the centers of the two sets of slots involve a 50° arc.

The typical slot wall height is 0.065 inch. The length of the slot walls is 0.216 inch and the width 0.076 inch. One slot wall thickness is 0.030 inch.

The diameter from center to the inner face of wall 101 is 0.940 inch, to the outer face of the wall is 1.000 inch and to the outer edge of flange 104 1.080 inches.

From the foregoing, it will be seen that this invention is one well adapted to attain all of the ends and objects hereinabove set forth together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be of the invention without departing from the scope thereof, it is to be understood that all matter herein set forth or shown in the accompanying drawings is to be interpreted as illustrative and not in a limiting sense.

I claim:

1. A drafting device for use with a template for cutting concentric shapes with respect to template patterns, comprising:

a flat, circular disc having upper and lower sides thereto, a circular wall of lesser outer diameter than the disc outer diameter fixed to the upper side of said disc circumferentially inboard of the peripheral edge thereof and concentric thereto, said circular wall relieved in at least one portion of the length thereof, with a slot through said disc in said relieved portion adapted to receive a cutting means therethrough, said slot aligned in its length with a tangent to said wall extended in said relieved portion.

2. A device as in claim 1 including a circumferential flange fixed to the top portion of said circular wall on the outboard face thereof and extending substantially parallel to the portion of said disc outboard of said wall.

3. A drafting device as in claim 1 including a metal ring surrounding a substantial portion of the periphery of said circular wall, a portion of the length of said ring overlying a portion of said slot.

4. A drafting device as in claim 1 including a metal ring surrounding a substantial portion of the periphery of said circular wall, a portion of said ring overlying a portion of said slot, and a circumferential flange fixed to the top portion of said circular wall on the outboard face thereof and extending substantially parallel to the portion of said disc outboard of said wall, said flange overlying and retaining said ring in position with respect to said wall.

5. A device as in claim 1 including a plurality of sequentially inwardly spaced slots provided through said disc inboard of said wall, said slots each successively spaced inwardly a greater distance from said wall, whereby to permit the production of a series of equidistant concentric cuts with respect to a template pattern.

6. A device as in claim 5 wherein each of said inwardly spaced slots is surrounded by an upstanding wall a substantial portion of the height of the said circular wall.

7. A device as in claim 6 wherein the wall surrounding the slot next inboard to the circular wall is integral in a portion thereof with said wall.

8. A device as in claim 1 including a vertical peripheral extension formed on said wall opposite said slot and a broken metal ring encircling the periphery of said wall with its free ends abutting said extension and a portion of said ring overlying a portion of said slot.

9. A device as in claim 8 including a circumferential flange fixed to the top portion of said circular wall on the outboard face thereof and extending substantially parallel to the portion of said disc outboard of said wall, said flange overlying and retaining said metal ring thereunder.

* * * * *